US009725218B2

(12) United States Patent
Stryker et al.

(10) Patent No.: US 9,725,218 B2
(45) Date of Patent: Aug. 8, 2017

(54) DISPENSING LID

(71) Applicants: Douglas G. Stryker, Flemington, NJ (US); Lonnie S. Lauer, Quinton, VA (US)

(72) Inventors: Douglas G. Stryker, Flemington, NJ (US); Lonnie S. Lauer, Quinton, VA (US)

( * ) Notice: Subject to any disclaimer, the term of this patent is extended or adjusted under 35 U.S.C. 154(b) by 0 days.

(21) Appl. No.: 14/721,119

(22) Filed: May 26, 2015

(65) Prior Publication Data

US 2015/0353244 A1 Dec. 10, 2015

Related U.S. Application Data

(63) Continuation of application No. 14/298,438, filed on Jun. 6, 2014.

(51) Int. Cl.

| | |
|---|---|
| ***B65D 47/06*** | (2006.01) |
| ***B65D 51/24*** | (2006.01) |
| ***B65D 43/06*** | (2006.01) |
| ***B44D 3/12*** | (2006.01) |

(52) U.S. Cl.

CPC ..... *B65D 47/06* (2013.01); *B44D 3/127* (2013.01); *B65D 43/06* (2013.01); *B65D 51/242* (2013.01)

(58) Field of Classification Search

CPC ..... B65D 47/06; B65D 43/06; B65D 51/242; B65D 25/24; B65D 43/0204; B44D 3/127; B44D 3/08

See application file for complete search history.

(56) References Cited

U.S. PATENT DOCUMENTS

| | | | | |
|---|---|---|---|---|
| 948,883 | A * | 2/1910 | Hughes | B65D 81/3222 137/364 |
| 2,155,259 | A | 4/1939 | Dickson | |
| 3,042,267 | A * | 7/1962 | Reynard | B67D 3/00 222/185.1 |
| 4,034,901 | A | 7/1977 | Kirk | |
| 5,104,003 | A * | 4/1992 | Stecoza | B67B 7/28 222/185.1 |
| 5,669,526 | A | 9/1997 | Keyfauver | |
| 5,944,232 | A * | 8/1999 | Hestehave | B65D 1/0223 222/146.6 |
| 5,947,319 | A | 9/1999 | Sinski | |
| 6,540,111 | B2 * | 4/2003 | Sunnarborg | B67D 3/0025 222/129 |
| 6,793,102 | B2 * | 9/2004 | Tan | B67D 1/1247 222/185.1 |
| 6,820,772 | B1 * | 11/2004 | Bennett, Jr. | B67D 3/048 222/185.1 |

(Continued)

OTHER PUBLICATIONS

Office Action dated Jul. 29, 2015 in related parent U.S. Appl. 14/298,438, filed Jun. 6, 2014.

(Continued)

*Primary Examiner* — Frederick C Nicolas
*Assistant Examiner* — Bob Zadeh
(74) *Attorney, Agent, or Firm* — Thedford I. Hitaffer; Hitaffer & Hitaffer, PLLC

(57) ABSTRACT

A lid comprises a support extending from the lid that is used to maintain a container in an inverted position. The lid further comprises a dispenser, such that when the lid is connected to a container and the container is inverted, gravity compels contents of the container out the dispenser.

19 Claims, 5 Drawing Sheets

(56) References Cited

U.S. PATENT DOCUMENTS

| | | | | |
|---|---|---|---|---|
| 6,892,903 | B1 * | 5/2005 | Bartolotta | B67D 3/0035 222/185.1 |
| 2006/0283883 | A1 * | 12/2006 | Mika | B67D 3/0009 222/129 |
| 2015/0353243 | A1 * | 12/2015 | Stryker | B65D 47/06 222/173 |
| 2015/0353244 | A1 * | 12/2015 | Stryker | B44D 3/127 222/185.1 |

OTHER PUBLICATIONS

Partial Search Report Action dated Dec. 1, 2015 in related European Patent Application 15170649.6-1704.

* cited by examiner

DISPENSING LID

I. BACKGROUND

A. Field of Invention

The present invention generally relates to lids and dispensers. Particularly, the present invention relates to a lid-dispenser for containers and includes a stand. Even more particularly, dispensed material is a flowable.

B. Description of the Related Art

A lid typically used to retain flowable material in a container, such as paint, stains, shellac, varnish, thinners, and other corrosive, hazardous and or toxic materials, typically has a ridge formed about an underside that acts as means to secure the lid to a complimentary groove disposed about the periphery of the container. In order to access or dispense materials from a container, the lid must first be pried off by separating the ridge from the groove, usually by a flat edge. Typically, contents of the container are then dispensed by lifting the container and tilting or inverting it, in order to use gravity to direct contents therefrom.

When contents are dispensed in this fashion, it is not unusual for material to collect in the groove of the container, exhibit an uncontrolled flow, or be subject to spillage for example when a user is fatigued or reckless. As a result, material is ultimately wasted and may result in injury. Additionally, if the lid is reattached or resealed to the container, material that collected within the groove is forced out by the ridge of the lid, causing an undesirable and uncontrollable splatter which may further subject a user to additional injury, not to mention additional waste of material. Furthermore, material that has collected in the groove must be cleaned properly, otherwise integrity of the seal formed by the groove and ridge is compromised and allows toxic vapors to release, allows quality of the contents to diminish, and further subjecting waste of material if the container is spilled.

Accordingly, there is a need in the industry for a way to access and or dispense contents from a container that would allow a user to control the flow of contents therefrom, as well as reduce the amount of waste and minimize injury.

II. SUMMARY

The instant invention is a lid that connects to a container and dispenses contents therefrom in a controlled fashion. An embodiment includes a lid that replaces an original lid on a container, wherein said container contains flowable material for example corrosive, hazardous and or toxic materials. It is an embodiment of the invention that the lid can be universally sized and shaped to connect to the container in an airtight fashion to protect and hold material within the container, thus providing an option to reconnect an original lid without fear of waste or injury. In an embodiment, the lid comprises means to connect to variable sized container and or container openings.

In an embodiment, for example when the container holds flowable material, for example, the corresponding replacement lid in accordance with the instant invention comprises a geometry that directs said material beyond the lid in a controlled manner. In an embodiment, the internal geometry of the replacement lid may comprise a funnel-like or sloping geometry that communicates with a spout, tube and/or conduit. The flow rate of material directed thereto may be regulated by a control valve.

In an embodiment, the lid comprises support means that maintain the container in an inverted position, when the lid is attached thereto. In this arrangement, gravity acts as a force to direct material out from the container and through the lid. In an embodiment, support means extend out from a surface of the lid. Said support means may include legs fashioned like a tripod, which can be individually adjusted by extension and retraction. It is an embodiment of the invention that the legs can also be segmented and hinged.

In a further embodiment of the invention, internal geometry of the lid is flat and the support means is manipulated, sized and/or shaped to direct flowable material out through the lid.

III. BRIEF DESCRIPTION OF THE DRAWINGS

The invention may take physical form in certain parts and arrangement of parts, some embodiments of which will be described in the specification and illustrated in accompanying drawings which form a part hereof, wherein, FIG. 1 is an embodiment of the invention showing an inverted container (20) connected to a lid (30) according to an embodiment of the instant invention. As shown in the embodiment, the lid (30) has three legs (70) as support means, which extend from said lid (30) in a tri-pod configuration, for example. As shown, a conduit (50) extends from underside of lid (30).

FIG. 2 is an embodiment of the instant invention as shown in FIG. 1, providing how a conduit (50) may consist of elements such as connecting means (55), a conduit (50') and a spout (130) that are releseably attached to lid (30).

FIG. 3 is a cross sectional view of an embodiment of the invention, showing internal geometry of an interior surface of the lid (30) as concave and or funnel-like and comprises connection means (40) disposed about internal surface of lid (30). FIG. 3 further provides an additional embodiment of the instant invention, wherein the interior surface of the lid may accommodate a smaller sized container (the smaller container being shown in broken lines).

FIG. 4 is a cross sectional view of an embodiment of the invention wherein lid (30) comprises a notch (140) that connects to lip (150) of container (20) and may further comprise gasket (145).

FIG. 5 is a cross sectional view of an embodiment of the invention showing an internal geometry of the interior surface of lid (30), which is slanted and or funnel-like, having a conduit (50) that extends from a side of lid (30). FIG. 5 also provides an embodiment whereby support means (70) may be integrally formed with lid (30), such that both are a single unit, whereby support means (70) extends about the perimeter of lid (30) and is substantially hollow. (See also FIGS. 8 and 9.)

IV. DETAILED DESCRIPTION OF THE INVENTION

An embodiment of the instant invention is for a lid that consists of support means used to maintain a container in an inverted position, at a sufficient height, and provides for dispensing of contents therefrom through use of gravity, for example.

Applicant generally refers to U.S. Pat. No. 6,715,647 (Ivins) FIG. 4 for reference as to an inverted container; and refers to U.S. Pat. No. 4,034,901 (Kirk), FIG. 2 for reference as to connection means between a container and lid that is subject to an embodiment of the instant invention. The disclosures of which are hereby incorporated.

Figure 1:
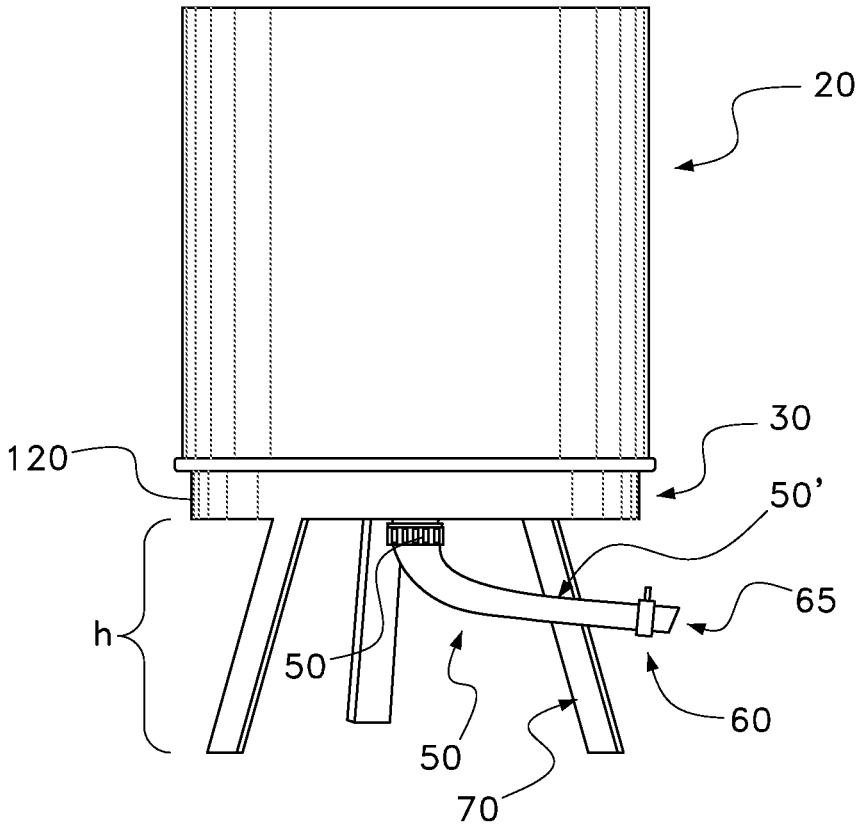
Figure 2:
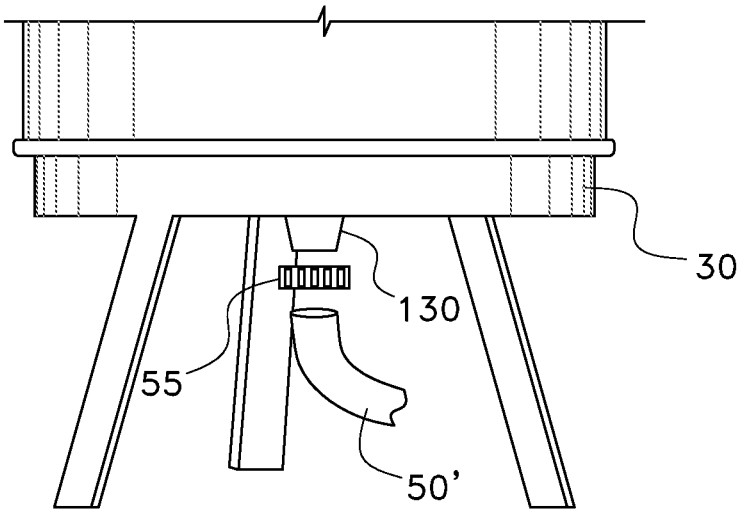
Figure 3:
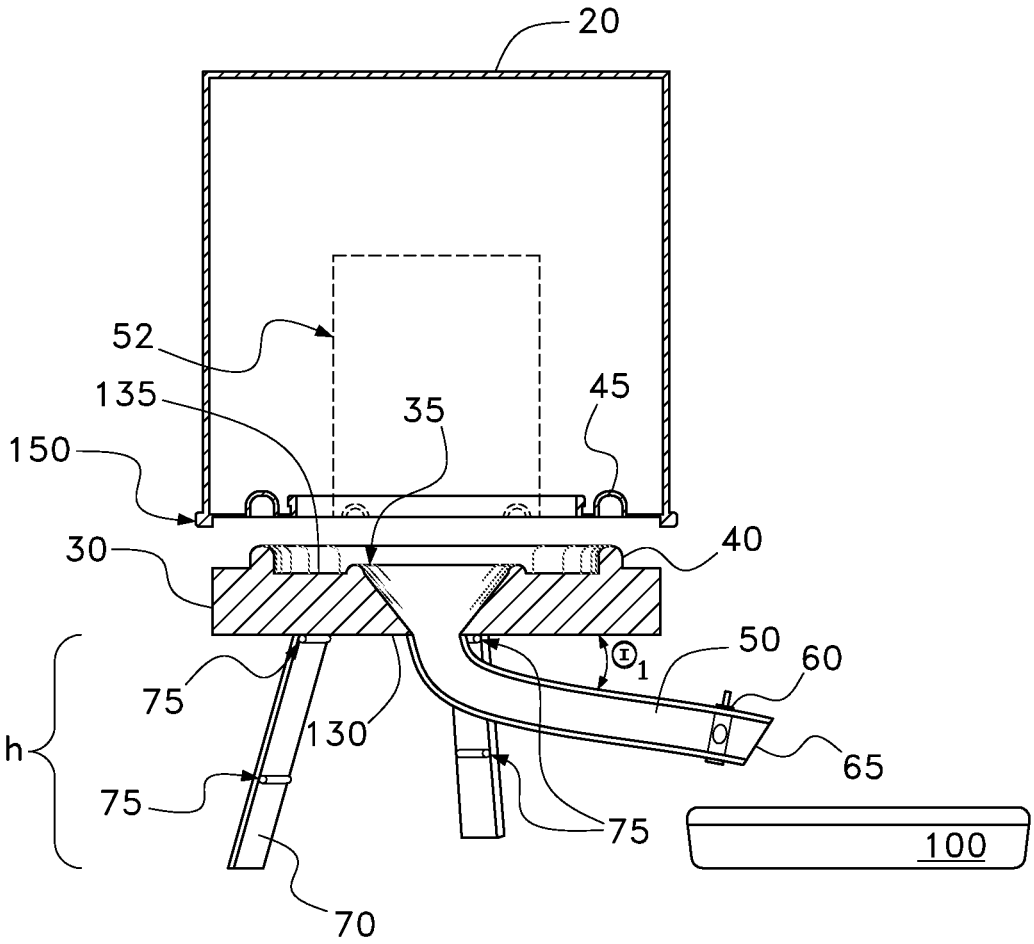

As shown in FIG. 1, lid 30 comprises support means 70 that maintains an inverted container at a height sufficient to allow contents not limited to paint, stains, shellac, varnish, thinners, and other corrosive, hazardous and or toxic materials, to be dispensed from lid 30. Lid 30 comprises connection means to be secured to a container in an airtight fashion to avoid ingress or egress. As shown in FIG. 3, connection means includes ridge 40 disposed about an inner edge of lid 30, shaped and sized to mimic means of an original lid (i.e., complimentary to a groove 45 disposed about an opening of a container, the groove as referenced by (12) in Kirk. It is within the scope of the invention that connection means of lid 30 may mimic that of a prior lid so that a complimentary connection is made with a different container. As shown in FIGS. 3, 5, 6 and 7 for example, container 20 may comprise a groove 45 disposed about the periphery of its opening, which is generally known for containers that include paint, primer, shellac varnish, stain, and other like material. Accordingly, an embodiment of lid 30 includes a ridge 40 disposed about the interior surface to correspond to the groove 45. Additionally, U.S. Pat. No. 4,034,901 (Kirk) discloses a Dripless Spout for Cans, and provides in FIG. 2 a cross section that shows a groove-ridge connection means, the disclosure of which patent is incorporated herein.

Lid 30 may be formed of any material not limited to glass, metals and plastics, so long as it may be able to maintain the integrity and shape as proscribed herein. It should be understood that interior surface of lid 30, which comes into contact with contents of said container 20, be non-reactive to contents of container 20 and have a low coefficient of friction.

Conduit 50 extends from lid 30 to direct materials therefrom. Conduit 50 may be integrally formed to lid 30 and or be a single unit, or may comprise of elements such as a spout 130, a tube 50' and a connection means 55, as shown in FIG. 2. In the embodiment in FIG. 2, cleaning and or replacement of a dirty or damaged elements of said conduit 50 may be facilitated by removing and or disconnecting elements (55 and 50') cleaning and reassembling. Connecting means 55 may include temporary devices such as a clamp, clasp, or other known means that can releseably secure tube 50' to said spout 130.

In an embodiment, means 55 allows tube 50' to pivot and or rotate relative to spout 130 and or lid 30. It is further an embodiment of the invention that lid 30 may be manufactured separately than the conduit 50, and bonded or assembled thereafter. Accordingly, it is within the scope of the invention that tube 50' may connect to spout 130 by more permanent means, such as adhesive or solder, etc. As provided, a regulator 60, may be disposed about the opening 65 of conduit 50 to control the flow of material therefrom, such as paint into a paint tray 100 for example. A regulator subject to the invention controls the flow of material and includes a spigot and control valve and other like means that may be used to start, stop, or regulate said flow. It is considered within the scope of the invention that said regulator may be disposed of anywhere between opening 65 and lid 30.

As provided in the figures, support means 70 extends, releseably connects, and or telescopes from lid 30 to maintain lid 30 at a height, h, when in an inverted position. Typically, h, should maintain lid 30 a sufficient distance above a surface such that opening 65 can directly dispense into a tray 100 for example. In embodiments disclosed in FIGS. 1-4, 6 and 7 support means 70 consist of three (3) legs, arranged in a fashion much like a tripod. It is an embodiment of the invention that support means 70 may be integrally formed to lid 30 (i.e., be an extension thereto as in FIGS. 5, 8 and 9), be releseably attached and or hinged.

Figure 7:
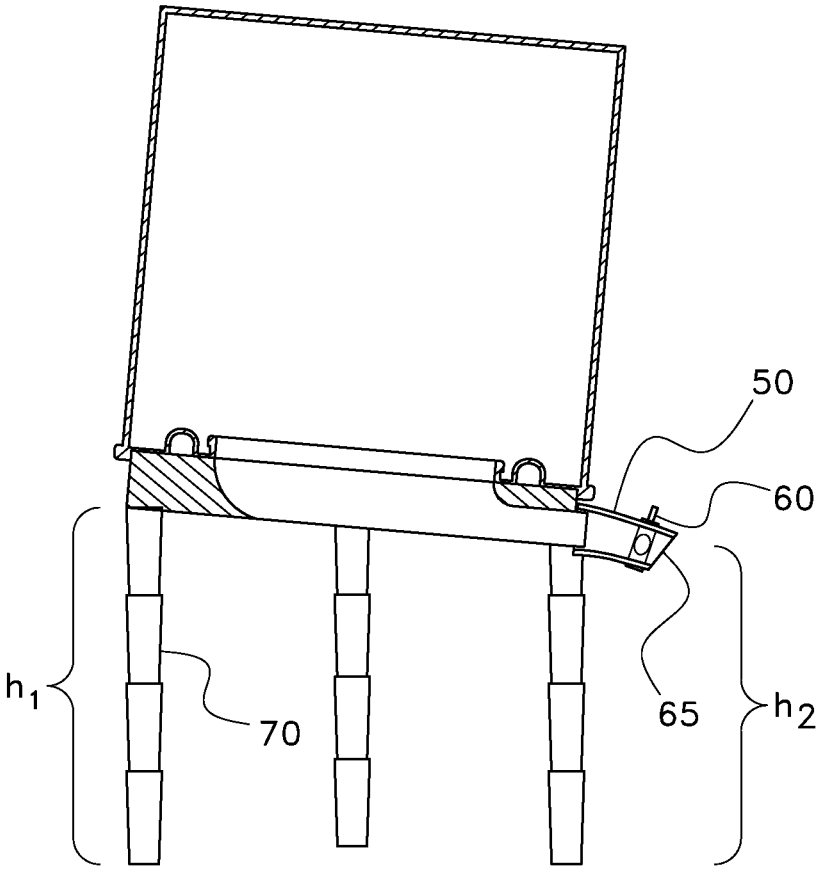
FIG. 7 is a cross sectional view of an embodiment of the invention wherein the internal geometry of the interior surface of the lid (30) is funneled to a substantially flat interior, whereby support means (70) is adjustable to provide a tilt, to direct contents therefrom.

In the embodiment as shown in FIG. 7, support means 70 is telescoping. In the embodiment, support means 70 consists of three (3) telescoping legs. Application of telescoping support means is beneficial in order to be able to retract support means during storage and to compensate for uneven surfaces, for example. Additionally, it is an embodiment of the invention that at least one leg may be telescoping in the embodiment as disclosed in FIG. 7, for example, wherein internal geometry of lid 30 may be substantially flat. Furthermore, it is an embodiment of the invention that for embodiments disclosed in FIGS. 5 and 8, a portion of the FIG. 3 is a cross sectional view of an embodiment of the invention. As shown (and incorporated by Kirk) ridge 40 is disposed about an interior surface of lid 30 and is sized and shaped to connect with groove 45 disposed about the periphery of the opening of container 20. It should be noted that the connectivity between lid 30 and container 20 is like the connectivity of container 20 with a previous and or original lid.

Figure 4:
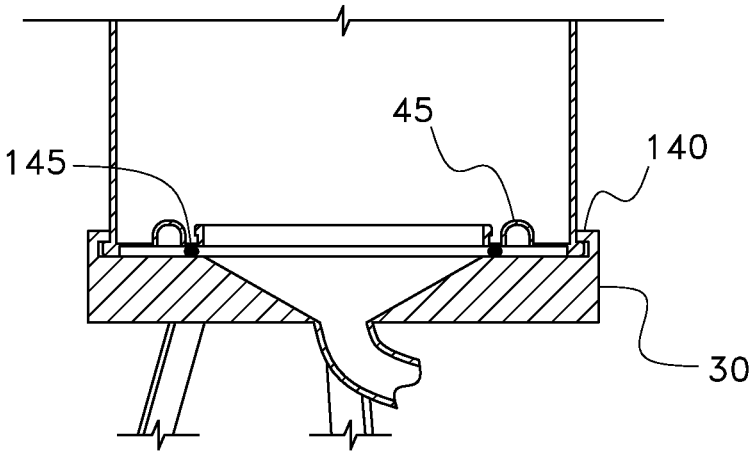

It is within the scope of the invention that lid 30 may comprise similar and or identical means as an original lid, in order to attach to a respective container 20, not limited to paint can. For example, it is well-known that many containers, may not have a groove 45 like container 20 disclosed herein, yet it may have other connectivity means. By way of example of container 20 presented herein, the typical paint container has a lip 150 that is disposed around the outside periphery of the opening of container 20. Accordingly, while it is an embodiment of the invention that ridge 40 is used to connect to said container 20, it is within the scope of the invention that lid 30 comprise means such as a notch 140 that is shaped and sized to connect to lip 150 as shown in FIG. 4. Notch 140 may comprise means not limited to frictional forces, a clamp, clasp, or deformable material for example. In the embodiment, as shown in FIG. 4, a gasket 145 may be disposed about the inner surface of lid 30 to prevent flowable material from escaping and or entering groove 45. The gasket 145 may be a deformable material, such that when notch 140 engages with lip 150, a region between about the opening of can 20 and lip 150 will compress gasket 145 creating an impervious barrier thereto.

A further embodiment of lid 30 provides for an additional ridge 35 concentrically formed about the inner surface of lid 30. The inner ridge is like ridge 40, but ridge 35 is designed to be able to accommodate containers that have a smaller sized opening as shown by a smaller container in broken lines.

As further shown in FIG. 3, lid 30 comprises an escape (i.e., conduit 50) that communicates with the internal geometry of lid 30 to direct flowable material when container 20 is inverted. (As shown, conduit 50 and lid 30 are integrally formed.) Furthermore, the internal geometry is concave or funnel like, directing flow therefrom, however, it should be understood that the lid may exhibit any geometry as contents should naturally be compelled to escape when container is inverted. As shown, conduit 50 communicates with said internal geometry and may extends from the lid 30 at an angle $\theta_1$, which may be between about 10 degrees to about 90 degrees relative to the plane of lid 30 as shown, so that the force of gravity would compel the majority, if not all flowable material to exit opening 65. As stated, it is within the scope of the invention that conduit 50 may be integrally formed with lid 30 and comprise like materials which can be rigid and include materials such as plastic or metal. Furthermore, it is within the scope of the invention that conduit 50 may comprise pliable material, and or be releaseably connected, wherefore the direction of flow of materials out from opening 65 can be manipulated by merely stretching or bending conduit 50 for example. FIG. 3 additionally provides an embodiment of support means 70 wherein said may comprise three (3) legs that can include a series of hinges 75 in order to allow for the legs to be bent and positioned out of place when lid 30 is not in use and or when it is being stored.

Figure 5:
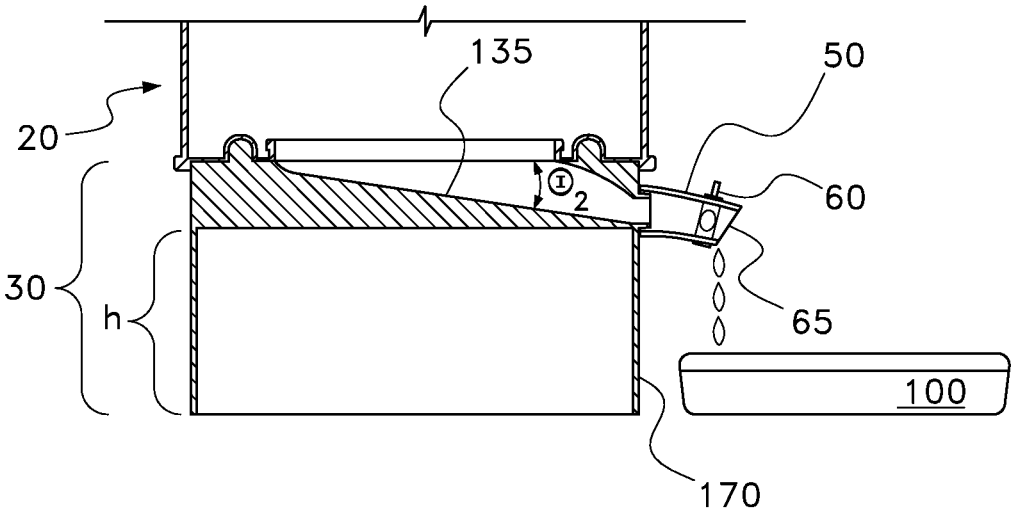
Figure 6:
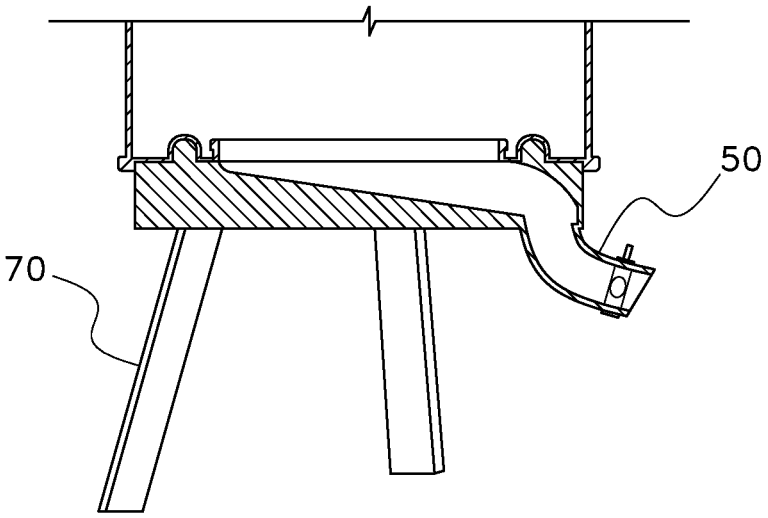
FIG. 6 is cross sectional view of an embodiment of the invention showing the internal geometry of the interior surface of the lid (30), like that shown FIG. 5, wherein conduit (50) is integrally formed and extends from underside of lid (30) about the perimeter.
Figure 8:
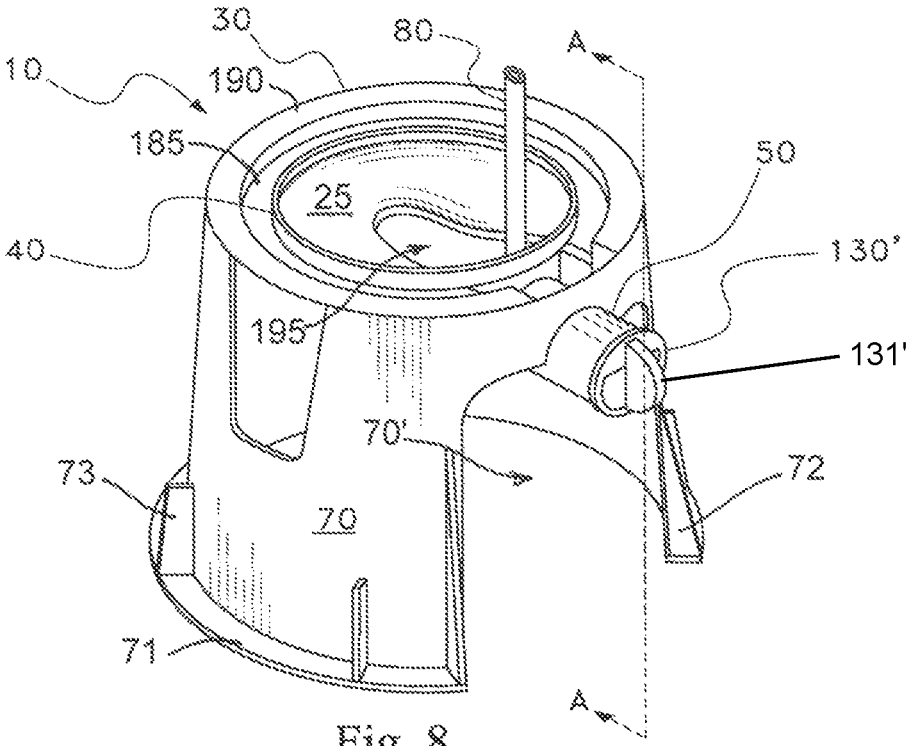
FIG. 8 is an embodiment of the instant invention wherein support (70) is an extension of lid (30) and or is a single unit. The embodiment as shown further provides disclosure of a vent (80).
Figure 9:
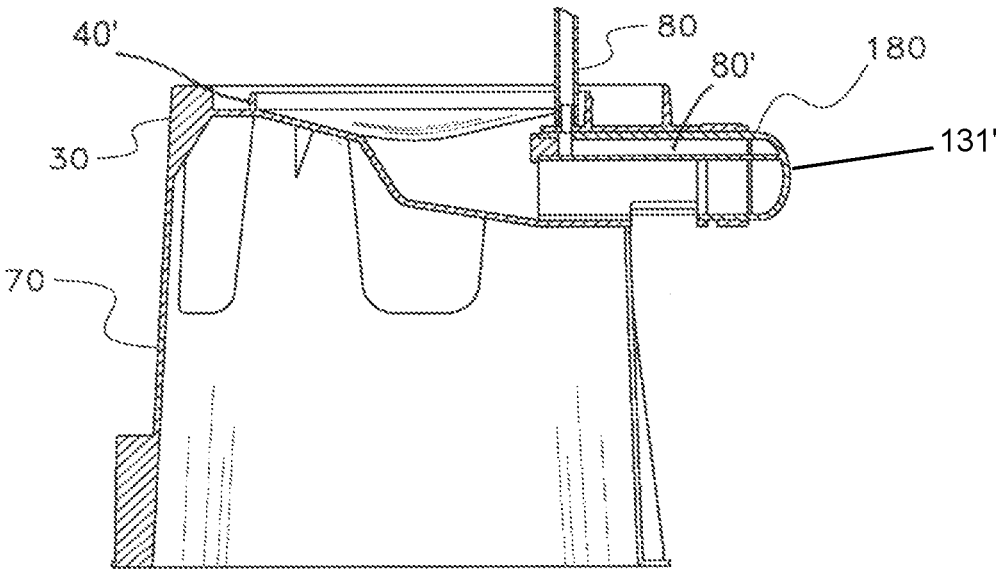
FIG. 9 is cut away of the embodiment of the invention as shown in FIG. 8 along plane A, and discloses an internal geometry of the interior surface of the lid (30) and support means (70), including an embodiment of a vent (80).

FIG. 5 is a cross section of another embodiment of the instant invention whereby the interior geometry of lid 30 comprises slope 135. As shown, flowable material will be directed down funnel and or slope 135 to and through conduit 50. In the embodiment, conduit 50 extends from side 120 of lid 30, as opposed to about the center surface as shown in FIGS. 1-4, or edge as shown in FIG. 6, for example. In this embodiment, the length of conduit 50 may be lessened, thereby reducing costs associated with production, among other benefits. The slope 135 can be at an angle $\theta_2$, which can be from at about 10 degrees to about 80 degrees, or less than about 45 degrees as shown. As shown, support means 70 is an extension of lid 30. A further embodiment of support means 70 as an extension of lid 30 may be found in FIGS. 8 and 9. As shown in FIGS. 8 and 9, lid 30 comprises an internal geometry that directs material through conduit 50 and spout 130'. Support means 70 comprises a wall that extends from about the perimeter at one end and substantially is in contact with a surface. It is within the scope of the invention that support means 70 may comprise a single wall as shown, i.e., substantially hollow, or it may be solid, so long as support means 70 is capable of maintaining lid 30 at a height sufficient to allow flowable material, such as paint (indicated by droplets in the FIG. 5) to dispense into a paint tray 100 for example. With further regard to FIGS. 8 and 9, an embodiment of a vent 80 is further disclosed. As shown, vent 80 may draw air from a hole 180 which is shown to be formed in conduit 50 to assist in aspirating the flow of materials therefrom.

FIG. 6 provides an embodiment of the invention wherein the internal geometry of lid 30 comprises a slope and or funnel that is similar to embodiment disclosed in FIG. 5 however, conduit 50 extends from lid 30 about the edge and is integrally formed. As shown, support means 70 are fashioned like the disclosure in FIG. 1 for example. (But, because the angle of the cut away, the third leg is not visible because it has been cut away as similar to FIGS. 3 and 4.)

The dispensing lid 30 shown in FIGS. 8 and 9 comprises an annular ridge 40 that is sized to removably engage the annular groove of a container so as to connect the lid 30 to the container and form a seal therebetween. A bead 40' is provided on an outer surface of the annular ridge 40 for engaging the annular groove. A concave bowl 25 has a perimeter bounded by the annular ridge 40. The concave bowl 25 receives flowable material from the container through use of gravity when the lid is connected to the container and the container is in an inverted position. An annular trough 185 is provided about the annular ridge 40, opposite the concave bowl 25, for receiving the rim of the container when the lid is connected to the container. An annular surface 190 is provided about the annular trough 185. A perimeter wall 70 extends downward from the annular surface 190 and terminates in a lower portion that engages a supporting surface so as to form a stand that supports the container in an inverted position. A drain opening 195 is provided in the bottom of the concave bowl 25. The concave bowl 25 is shaped to direct the flowable material into the drain opening 195. The drain opening 195 is an elongated opening extending from a central region of the concave bowl 25 in a radial direction toward the annular ridge 40. A conduit is in fluid communication with the drain opening 195. The conduit comprises a tube 50 and a spigot 130' that is in fluid communication with the tube 50. The spigot 130' is positioned radially outward, beyond the perimeter wall 70. Flowable material received from the container into the concave bowl 25 flows into the drain opening 195 and then further into the tube 50. A control valve 131' between the tube 50 and the spigot 130' is structured to operably control flowable material from the tube 50 through the spigot 130'.

The perimeter wall 70 supports the container at a height that permits the flowable material to flow from the spigot 130' into a paint tray. The perimeter wall 70 has a front portion with an opening 70' in a lower region thereof to provide clearance for a paint tray. A base 71 extends in a radial direction outward from the lower region of the perimeter wall 70. The base is engageable with the supporting surface to improve stability of the lid when supported by the supporting surface. Upwardly extending elongate flanges 72 are positioned in spaced relation adjacent opposing sides of the opening 70' in the perimeter wall 70 and extending between the base 71 and the perimeter wall 70. Flanges 73 are positioned in spaced relation to another and extend between the base 71 and the perimeter wall 70 to provide structural support therebetween. The perimeter wall 70 is disposed at an angle so that the perimeter wall 70 generally has a frustoconical shape. The perimeter wall 70, the annular ridge 40 and the concave bowl 25 are integrally formed so as to form a unitary, one-piece construction, and are formed from plastic material.

A vent 80 is provided through which air may be drawn when dispensing flowable material from the container. The vent comprises a channel 80' supported in relation to the conduit. The channel 80' is in fluid communication with a hole 180 through which air may be drawn from outside the container and lid 10. The vent comprises a vent tube 80 originating from within the concave bowl 25. The vent tube 80 is substantially rigid and extends in an upward direction. The vent tube 80 is removable so that the removable vent tube is subject to be cleaned or replaced.

In view of the several embodiments presented herein, various changes and modifications may be made without departing from the spirit and scope of the Invention, not limited to the exchanging and substitution of known features and exchanging and substituting features disclosed herein with other embodiments. It is intended that such obvious changes and modifications be embraced by the annexed claims.

What is claimed is:

1. A dispensing lid for dispensing flowable materials from a container in a controlled fashion, the container having an annular groove atop the container and an opening bounded by the annular groove, the lid comprising:

an annular ridge that is sized to removably engage the annular groove so as to connect the lid to the container and form a seal therebetween, a concave bowl having a perimeter bounded by the annular ridge, the concave bowl for receiving flowable material from the container through use of gravity when the lid is connected to the container and the container is in an inverted position, a stand comprising a supporting surface and a perimeter wall to support the container in the inverted position at a height above the supporting surface, an annular surface about an annular trough, the annular trough between the annular ridge and the annular surface, the perimeter wall extending downward from the annular surface, a drain opening in a bottom region of the concave bowl, the drain opening being sized to allow the flowable material to freely flow therethrough, a conduit beneath the concave bowl, the conduit being in fluid communication with the drain opening, the conduit comprising a tube in fluid communication with the drain opening and a spigot in fluid communication with the tube, whereby the flowable material received from the container flowing through the drain opening and is free to flow into the tube, a control valve structured and positioned to operably control the flowable material through the spigot from the tube.

2. The dispensing lid of claim 1, further comprising a bead on an outer surface of the annular ridge for engaging the annular groove.

3. The dispensing lid of claim 1, wherein the height at which the perimeter wall supports the container is sufficient to permit the flowable material to flow from the spigot into a paint tray.

4. The dispensing lid of claim 3, wherein the perimeter wall has front portion with an opening in a lower region thereof to provide clearance for the paint tray.

5. The dispensing lid of claim 1, further including a base extending in a radial direction outward from the perimeter wall, the base being engageable with the supporting surface to improve stability of the lid when supported by the supporting surface.

6. The dispensing lid of claim 5, further comprising a pair of upwardly extending elongate flanges positioned in spaced relation adjacent opposing sides of the opening in the perimeter wall and extending between the base and the perimeter wall to provide structural support therebetween.

7. The dispensing lid of claim 5, further comprising a plurality of flanges positioned in spaced relation to another and extending between the base and the perimeter wall to provide structural support therebetween.

8. The dispensing lid of claim 1, wherein the perimeter wall is disposed at an angle so that the perimeter wall generally has a frustoconical shape.

9. The dispensing lid of claim 1, wherein the perimeter wall, the annular ridge and the concave bowl are integrally formed so as to form a unitary, one-piece construction.

10. The dispensing lid of claim 9, wherein the perimeter wall, the annular ridge and the concave bowl are formed from plastic material.

11. The dispensing lid of claim 1, wherein the concave bowl is shaped to direct the flowable material into the drain opening.

12. The dispensing lid of claim 1, wherein the drain opening is an elongated drain opening extending from a central region of the concave bowl in a radial direction toward the annular ridge.

13. The dispensing lid of claim 1, wherein the spigot is positioned radially outward, beyond the perimeter wall.

14. The dispensing lid of claim 1, further comprising a vent through which air may be drawn when dispensing flowable material from the container.

15. The dispensing lid of claim 14, wherein the vent comprises a channel supported in relation to the conduit, the channel being in fluid communication with a hole through which air may be drawn from outside the container and lid.

16. The dispensing lid of claim 14, wherein the vent comprises a vent tube, the vent tube originating from within the concave bowl, the vent tube being substantially rigid and extending in an upward direction.

17. The dispensing lid of claim 16, wherein the vent tube is removable so that the removable vent tube is subject to be cleaned or replaced.

18. The dispensing lid of claim 1, wherein surfaces of the lid that come into contact with the flowable material are non-reactive to the flowable material and have a low coefficient of friction.

19. A dispensing lid for dispensing flowable materials from a container in a controlled fashion, the container having an annular groove atop the container and an opening bounded by the annular groove, the container having a rim about an outer portion of the groove, the lid comprising:

a concave bowl having a perimeter bounded by an annular ridge sized to engage the annular groove so that the lid is attachable, removable and re-attachable to the container, engagement of the annular ridge and the annular groove forming a seal between the annular ridge and the annular groove, the concave bowl being in fluid communication with the opening of the container so as to receive flowable material from the container when the annular ridge is engaged with the annular groove and the container is in an inverted position, an annular trough for receiving the rim of the container when the annular ridge engages the annular groove, an annular surface about the annular trough, the annular trough between the annular ridge and the annular surface, a stand comprising a perimeter wall extending downward from the annular surface and terminating in a lower portion that engages a supporting surface to support the container in an inverted position, a drain opening in the bottom of the concave bowl, a conduit in fluid communication with the drain opening, the conduit comprising a tube and a spigot in fluid communication with the tube, whereby the flowable material received from the container into the bowl flows into the drain and then further into the tube, a control valve between the tube and the spigot, the control valve being structured to operably control the flowable material through the spigot from the tube.

* * * * *